US008161936B2

(12) United States Patent
Kraft et al.

(10) Patent No.: US 8,161,936 B2
(45) Date of Patent: Apr. 24, 2012

(54) INTERNAL COMBUSTION ENGINE HAVING A MOTOR BRAKE ASSEMBLY

(75) Inventors: Florian Kraft, Nürnberg (DE); Thomas Leitel, Nürnberg (DE); Norbert Schatz, Nürnberg (DE)

(73) Assignee: MAN Truck & Bus AG, München (DE)

( * ) Notice: Subject to any disclaimer, the term of this patent is extended or adjusted under 35 U.S.C. 154(b) by 22 days.

(21) Appl. No.: 12/896,572

(22) Filed: Oct. 1, 2010

(65) Prior Publication Data

US 2011/0079196 A1 Apr. 7, 2011

(30) Foreign Application Priority Data

Oct. 2, 2009 (DE) ..... 10 2009 048 143

(51) Int. Cl.
*F02D 13/04* (2006.01)

(52) U.S. Cl. ..... 123/321; 123/90.15; 123/90.12; 123/90.43; 123/90.55

(58) Field of Classification Search ..... 123/90.12, 123/90.15–90.18, 90.43, 90.55, 321
See application file for complete search history.

(56) References Cited

U.S. PATENT DOCUMENTS

| | | | | |
|---|---|---|---|---|
| 4,756,496 | A | 7/1988 | Hosan et al. | |
| 4,913,104 | A * | 4/1990 | Mills | 123/90.4 |
| 5,692,469 | A | 12/1997 | Rammer et al. | |
| 6,293,237 | B1 * | 9/2001 | Vorih | 123/90.12 |
| 7,013,867 | B2 | 3/2006 | Rammer et al. | |
| 7,673,601 | B2 * | 3/2010 | Spath et al. | 123/90.16 |
| 7,882,810 | B2 * | 2/2011 | Vanderpoel et al. | 123/90.12 |
| 2002/0174849 | A1 | 11/2002 | Ruggiero et al. | |
| 2005/0000499 | A1 | 1/2005 | Ruggiero et al. | |
| 2005/0087170 | A1 | 4/2005 | Rammer et al. | |
| 2007/0144472 | A1 | 6/2007 | Yang | |

FOREIGN PATENT DOCUMENTS

| | | |
|---|---|---|
| DE | 34 20 528 | 12/1985 |
| DE | 10 2006 027 987 | 12/2007 |
| DE | 10 2007 014 248 | 9/2008 |
| EP | 0 736 672 | 10/1996 |
| EP | 1 526 257 | 4/2005 |
| WO | WO 2005/089274 | 9/2005 |
| WO | WO 2007/078309 | 7/2007 |

* cited by examiner

*Primary Examiner* — Erick Solis
(74) *Attorney, Agent, or Firm* — Cozen O'Connor

(57) ABSTRACT

An internal combustion engine includes an exhaust valve for removing exhaust gas from a combustion chamber and an engine braking device with a hydraulic valve control unit by which the exhaust valve can be held in an intermediate open position when the engine braking device is actuated. A hydraulic valve lash compensation mechanism for the exhaust valve and a control channel formed between the hydraulic valve control unit and the valve lash compensation mechanism for feeding oil to the hydraulic valve control unit that can be closed by a closure element to compensate for the valve lash of the exhaust valve. A counter-holder is constructed as a piston-cylinder unit. The counter-holder forms a variable stop for a valve bridge cooperating with the valve lash compensation mechanism.

12 Claims, 2 Drawing Sheets

INTERNAL COMBUSTION ENGINE HAVING A MOTOR BRAKE ASSEMBLY

BACKGROUND OF THE INVENTION

1. Field of the Invention

The invention is directed to an internal combustion engine and engine braking device having a valve control unit that holds an exhaust valve in an intermediate position when activated.

2. Description of the Related Art

An internal combustion engine of the type mentioned above is described, for example, in EP 1 526 257 A2. The engine braking device in this internal combustion engine is a combination of an engine exhaust brake and a compression release brake, also known as EVB (Exhaust Valve Brake). A hydraulic valve control unit is installed on one side in a valve bridge that actuates two exhaust valves simultaneously. The supply of oil to the valve control unit is carried out by the existing oil circuit in the internal combustion engine. Separate adjustment screws are provided for compensating valve lash in the exhaust valves and are used to adjust the valve lash when assembling the engine or afterwards at regular servicing intervals. This is uneconomical.

In the event that excessive valve lash is unintentionally adjusted by assembly or servicing personnel, chattering noises will result between the rocker arm and valve bridge and there is a risk that the valve train will be damaged. Further, the exhaust valves do not open sufficiently, so that a complete exchange of gas is not ensured. If insufficient valve lash is adjusted, there is a risk that the valves will not close completely in the hot state and will accordingly burn out.

SUMMARY OF THE INVENTION

It is an object of the invention to provide an internal combustion engine of the type mentioned above which enables a safe and reliable operation with the least possible expenditure on assembly and servicing.

The internal combustion engine according to one embodiment of the invention comprises a hydraulic valve lash compensation mechanism for the exhaust valve, which hydraulic valve lash compensation mechanism is arranged between the rocker arm and the valve bridge and is connected to the existing oil circuit for supplying oil. The hydraulic valve control unit is supplied with oil through the valve lash compensation mechanism and the control channel. The control channel can be closed by the closure element to adjust the valve lash of the exhaust valve so that when compensating valve lash the hydraulic valve control unit is not supplied with oil and the valve bridge and exhaust valve are located in a defined position. The hydraulic valve control unit is accordingly decoupled from the hydraulic valve lash compensation mechanism during valve lash compensation.

Owing to the fact that the backstop or counter-holder is constructed as a hydraulic piston-cylinder unit, the valve bridge is provided with a variable stop which is automatically adapted to the position of the valve lash compensation mechanism. A manual adjustment of the stop or of the clearance of the counter-holder relative to the valve bridge during assembly or at regular servicing intervals is not required.

Accordingly, the internal combustion engine according to one embodiment of the invention has the valve control unit required for achieving an engine braking force action as well as a compensation mechanism which automatically performs the valve lash adjustment. A time-consuming, costly and error-prone regular manual adjustment is obviated. Accordingly, compared to previous internal combustion engines outfitted with an engine braking device, the internal combustion engine according to one embodiment of the invention offers the added functionality of automatic valve lash adjustment for a safer, more efficient assembly and operation. In particular, the automatic valve lash adjustment minimizes chattering noise in the exhaust valve and prevents damage to the valve train due to insufficient valve lash adjustment. Further, there is no need for the automatic valve lash compensation mechanism to bridge over valve lash during operation of the internal combustion engine, so that the control times of the exhaust valve can be adhered to exactly and the exhaust gas behavior of the internal combustion engine is optimized.

Internal combustion engines without a hydraulic valve lash compensation mechanism can be retrofitted economically in that the valve control unit and valve lash compensation mechanism are connected to the existing oil circuit.

According to one embodiment, the automatic valve lash compensation mechanism economizes on space and makes it possible to retrofit internal combustion engines without a hydraulic valve lash compensation mechanism simply by replacing the valve bridge and counter-holder and by integrating the valve lash compensation mechanism in the valve bridge.

In one embodiment, a reliable closing of the control channel between the valve lash compensation mechanism and the valve control unit is ensured. Since the control piston is in its retracted home position when the engine braking device is not actuated, the control piston can close the control channel and therefore forms the closure element. In this way, a decoupling of the valve control unit and valve lash compensation mechanism for compensating valve lash is achieved without additional expenditure on construction so that the valve bridge and exhaust valve are in a defined position when compensating for valve lash.

A check valve prevents the extended control piston from retracting when the force generated by the oil pressure on the control piston is not sufficient for this purpose. Therefore, the exhaust valve is reliably blocked in the intermediate open position.

A counter-holder piston ensures an absolutely fixed stop for the valve bridge in engine braking operation. In the intermediate open position of the exhaust valve, oil flows through the supply channel into the counter-holder space so that the position of the counter-holder piston and, therefore, of the valve bridge is fixed.

A venting channel prevents compressible air from being trapped in the counter-holder space. The air in the counter-holder space can escape through the venting channel when filling with oil. The check valve prevents oil from escaping. Therefore, the counter-holder piston is prevented from giving way due to trapped air.

A bridging channel allows the counter-holder space and control space to be filled extremely quickly. The bridging channel opens directly from the oil supply channel into the connection channel and accordingly bridges the compensation space and the control channel so that the counter-holder space in particular can be filled faster.

The bridging channel can preferably be retrofitted in a simple manner by replacing the valve bridge and compensation piston.

A check valve ensures a reliable blocking of the control piston and of the counter-holder piston in engine braking operation. Accordingly, the exhaust valve is securely held in the intermediate open position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Other features, advantages and details of the invention are indicated in the following description of several embodiment examples with reference to the drawings. In the drawings.

DETAILED DESCRIPTION OF THE PRESENTLY PREFERRED EMBODIMENTS

Figure 1:
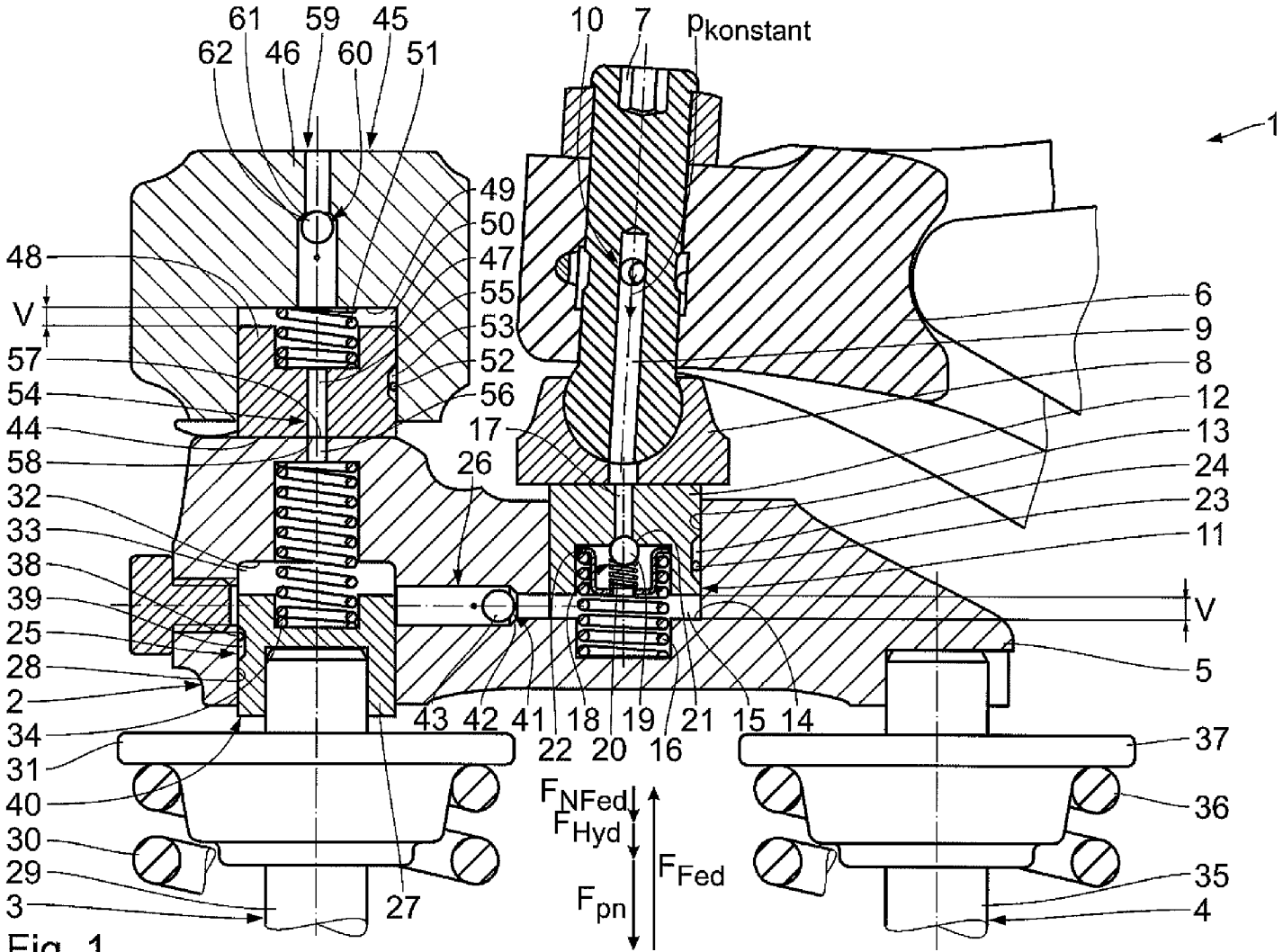
FIG. 1 is a cross-sectional view through a valve control unit and valve lash compensation mechanism according to a first embodiment example.

A first embodiment example of the invention will be described in the following with reference to FIG. 1. An internal combustion engine 1 with an engine braking device 2 has a plurality of cylinders, not shown in FIG. 1, which define a combustion chamber. Air or an air-fuel mixture can be supplied to each of these combustion chambers by at least one inlet valve. Further, two exhaust valves 3 and 4 through which exhaust gas can be carried off in an exhaust gas duct are associated with each combustion chamber. The exhaust valves 3 and 4 can be mechanically controlled and actuated by a common valve bridge 5. The valve bridge 5 is part of a connection mechanism which connects the exhaust valves 3 and 4 to a camshaft, not shown in FIG. 1, of the internal combustion engine 1. The connection mechanism comprises a pivotably mounted rocker arm 6 which acts on the valve bridge 5 via a contact stud 7. To this end, the contact stud 7 is provided at its free end with a support cup 8 which is articulated in the manner of a ball joint.

An oil feed channel 9 of an oil circuit 10 of the internal combustion engine 1, which is provided for lubrication as well as for hydraulic control, extends inside the contact stud 7 and the support cup 8. Oil that is guided in this oil feed channel 9 has approximately the same oil pressure $p_{konstant}$ during operation.

A hydraulic valve lash compensation mechanism 11, which is constructed as a piston-cylinder unit and automatically compensates the valve lash of the exhaust valves 3 and 4, is arranged between the rocker arm 6 and the valve bridge 5. The valve lash compensation mechanism 11 has a compensation piston 12 that is preferably U-shaped in longitudinal section and which is guided so as to be movable axially in a cylinder bore 13 formed in the valve bridge 5 and acting as a cylinder. In the position of the compensation piston 12 shown in FIG. 1, a compensation space 15 is formed between the compensation piston 12 and a boundary surface 14. A first reset spring 16 is arranged in the compensation space 15 between the boundary surface 14 and the compensation piston 12.

The valve lash compensation mechanism 11 is connected to the oil circuit 10. To this end, the compensation piston 12 which is in permanent contact with the support cup 8 owing to the action of the spring force of the reset spring 16 has a central oil supply channel 17 communicating with the oil feed channel 9. A first check valve 18 preferably a non-return valve, is provided at an end of the oil supply channel 17 facing the compensation space 15. The ball 19 of the check valve 18 is pressed into a ball seat 21 of the oil supply channel 17 by a check valve spring 20. For this purpose, the check valve spring 20 is supported against a supporting plate 22 which is held between the compensation piston 12 and the reset spring 16. The movement of the compensation piston 12 is limited by a first limiting pin 23 that extends in a piston recess 24 of the compensation piston 12.

The engine braking device 2 of the internal combustion engine 1 is an EVB type and, in addition to a throttle element in the exhaust gas duct and a central control unit for every cylinder (neither the throttle element nor the central control unit is shown in FIG. 1), comprises a hydraulic valve control unit 25 constructed as a piston-cylinder unit and is hydraulically connected to the valve lash compensation mechanism 11 by a control channel 26. The control channel 26 serves to supply oil to the valve control unit 25 which is connected to the oil circuit 10 by the control channel 26 and the valve lash compensation mechanism 11 in the position of the control piston 27 shown in FIG. 1.

The valve control unit 25 has a control piston 27 that is guided so as to be movable axially in a second cylinder bore 28 formed in the valve bridge 5 and which acts as a cylinder. The control piston 27 is preferably H-shaped in longitudinal section and is supported at the top end of a shaft 29 of the exhaust valve 3. The exhaust valve 3 is mounted such that its shaft 29 is movable axially in a cylinder head and is acted upon in the closing direction by a determined preloading force by means of a closing spring 30. The closing spring 30 is tensioned between the cylinder head and a spring plate 31. The closing force of the closing spring 30 is designated by $F_{Fed}$.

In the position of the control piston 27 shown in FIG. 1, a control space 33 is formed between a boundary surface 32 and the control piston 27. The control channel 26 is formed inside the valve bridge 5 and connects the compensation space 15 to the control space 33. A second reset spring 34 which contacts the boundary surface 32 and the control piston 27 and presses the latter against the shaft 29 is arranged in the control space 33. Accordingly, the spring force of the reset spring 34 acts against the closing force $F_{Fed}$ of the closing spring 30 and is designated by $F_{NFed}$.

The valve control unit 25 is arranged between the exhaust valve 3 and the valve bridge 5 and accordingly, in engine braking operation, cooperates only with exhaust valve 3 but not with exhaust valve 4. Exhaust valve 4 is mounted such that its shaft 35 is movable axially in the cylinder head corresponding to exhaust valve 3 and is acted upon in the closing direction by a corresponding preloading force by means of a closing spring 36. The closing spring 36 is tensioned between the cylinder head and a spring plate 37.

To limit the movement of the control piston 27, a limiting pin 38 extends in a lateral piston recess 39 of the control piston 27. The control channel 26 opens into the control space 33 in such a way that the control piston 27 forms a closure element 40 for the control channel 26 at its top dead center. A second check valve 41 having a ball 43 that can be received in a ball seat 42 is arranged in the control channel 26. The check valve 41 is oriented in such a way that it closes the control channel 26 when oil flows in direction of the compensation space 15. The control channel 26 opens into the compensation space 15 substantially flush with the boundary surface 14.

A counter-holder 45 is provided so as to furnish a stop 44 for the valve bridge 5. The counter-holder 45 is constructed as a hydraulic piston-cylinder unit and has a counter-holder base body 46 with a third cylinder bore 47 in which a counter-holder piston 48 is guided axially. The counter-holder piston 48 is preferably constructed so as to be U-shaped in longitudinal section. In the position of the counter-holder piston 48 shown in FIG. 1, a counter-holder space 50 is formed between the counter-holder piston 48 and a boundary surface 49. A third reset spring 51 which contacts the counter-holder piston 48 and boundary surface 49 is arranged in the counter-holder space 50. The movement of the counter-holder piston 48 is defined by a limiting pin 52 arranged in a lateral piston recess 53 of the counter-holder piston 48.

The counter-holder space 50 is connected by a supply channel 54 to the control space 33 and, accordingly, to the oil circuit 10. The counter-holder piston 48 has an axial through-hole 55 which is aligned with a corresponding bore hole 56 in the valve bridge 5 to form the supply channel 54. When the counter-holder piston 48 is lifted from the valve bridge 5, the supply channel 54 is interrupted. In this state, the borehole 56 forms a first control aperture 57 and the through-hole 55 forms a second control aperture 58.

A venting channel 59 is formed in the counter-holder base body 46. This venting channel 59 penetrates the counter-holder base body 46 starting from the counter-holder space 50 and connects it to the area of the cylinder cover. A fourth check valve 60 with a ball 62 which can be received in a ball seat 61 is arranged in the venting channel 59. The check valve 60 is oriented in such a way that the venting channel 59 can be closed in direction of the cylinder cover.

The operation of the engine braking device 2 and valve lash compensation mechanism 11 will be described in more detail in the following.

Engine braking operation will be discussed first. When the engine braking device 2 is actuated, the throttle element in the exhaust gas duct is moved into the throttle position so that exhaust gases are backed up in the exhaust gas duct between the exhaust valve opening of the cylinder and the throttle element. This back pressure in the exhaust gas duct together with the compression wave of the opening exhaust valves of the adjacent cylinders causes an intermediate opening of the exhaust valve 3 that occurs during the compression stroke and the expansion stroke of every Otto cycle of the internal combustion engine 1. Because of the pressure ratios prevailing in the combustion chamber of the cylinder and in the exhaust gas duct, a pneumatic force $F_{pn}$ results which opposes the closing force $F_{Fed}$ of the closing spring 30 and the above-mentioned intermediate opening of the exhaust valve 3. The spring force $F_{NFed}$ of the reset spring 34 moves the control piston 27 up to the exhaust valve 3 and reinforces the intermediate opening of the exhaust valve 3. The moving up of the control piston 27 causes an increase in the volume of the control space 33. At the same time, the control piston 27 acting as a closure element 40 releases the control channel 26 so that the oil required for the movement is made available to the control piston 27 via the control channel 26. Because of the vacuum pressure occurring in the control space 33, oil flows through the oil feed channel 9 and the oil supply channel 17, the compensation space 15 and the control channel 26 into the control space 33 so that a hydraulic force $F_{Hyd}$ acts on the control piston 27 and reinforces the reset spring 34.

Further, oil flows from the control space 33 via the supply channel 54 into the counter-holder space 50. Air located in the counter-holder space 50 can escape through the venting channel 59 because the check valve 60 preferably does not respond to the passage of air. Since the oil cannot escape from the control space 33 and counter-holder space 50 because of the check valves 41 and 60, the control piston 27 is held in position against the closing force $F_{Fed}$ of the closing spring 30, and the counter-holder piston 48 acts as a fixed stop 44 for the valve bridge 5 because the counter-holder space 50 is filled with compressed oil. Accordingly, the control piston 27 is hydraulically blocked in the valve bridge 5 so that the exhaust valve 3 which is mechanically coupled with the control piston 27 is held in the intermediate open position. Therefore, the exhaust valve 3 remains in the intermediate open position during the second stroke (compression stroke) and the following third stroke (expansion stroke) so that the desired engine braking effect takes place.

At the end of the third stroke, the rocker arm 6 loads the valve bridge 5 again due to the camshaft control in order to bring the exhaust valves 3 and 4 into the completely open position provided during the fourth stroke. The valve bridge 5 moves away from the counter-holder piston 48 due to the load exerted by the rocker arm 6 so that contact is broken off between it and the valve bridge 5, and the control apertures 57, 58 open. The oil located in the control space 33 can flow out into the area of the cylinder cover via the control aperture 57. The hydraulic blocking of the control piston 27 is canceled in this way. The flow of oil from the control space 33 is also supported in such a way that the control piston 27 is pressed back into its top dead center by the closing force $F_{Fed}$ of the closing spring 30. Further, the check valve 41 closes the control channel 26 during the return movement of the control piston 27. The oil located in the counter-holder space 50 can flow out into the area of the cylinder cover via the control aperture 58. As long as the control piston 27 does not yet completely close the control channel 26, oil flows out of the compensation space 15 via the control space 33 and control aperture 57 into the area of the cylinder cover so that the compensation piston 12 is pressed in direction of its bottom dead center.

During the return lift of the rocker arm 6, the valve bridge 5 contacts the counter-holder piston 48 again and forces it back against the spring force of the reset spring 51. Due to the spring force, the counter-holder piston 48 is pressed against the valve bridge 5 in such a way that the supply channel 54 is not interrupted. During the return lift, the control piston 27 remains at top dead center and accordingly continues to close the control channel 26. The valve bridge 5 and the exhaust valves 3 and 4 are accordingly in a defined position so that the valve lash compensation mechanism 11 can compensate for valve lash. The spring force of the reset spring 16 positions the compensation piston 12 in such a way that the valve lash is adjusted to substantially zero. Owing to the vacuum pressure in the compensation space 15, oil flows into the compensation space 15 via the check valve 18.

Normally fueled engine operation will be described in the following. In normally fueled engine operation, the throttle element in the exhaust gas duct stays in the open position. Since the exhaust valve 3 does not jump into an intermediate open position in normally fueled engine operation owing to the closing force $F_{Fed}$ of the closing spring 30, the control piston 27 remains in top dead center from the first stroke to the fourth stroke. Accordingly, the control channel 26 is constantly closed.

At the end of the third stroke, the rocker arm 6 loads the valve bridge 5 due to the camshaft control so as to move the exhaust valves 3 and 4 into the completely open position provided during the fourth stroke. The compensation piston 12 compresses the oil located in the compensation space 15. The compensation space 15 is sealed in direction of the oil supply channel 17 by the check valve 18. Owing to the exactly fitting surfaces of the compensation piston 12 and control piston 27, no oil can escape between the latter and the valve bridge 5 so that an incompressible oil cushion is formed in the compensation space 15 between the compensation piston 12 and the valve bridge 5. The force exerted by the rocker arm 6 on the compensation piston 12 is accordingly transmitted to the valve bridge 5 via the oil cushion. The valve bridge 5 moves away from the counter-holder 45 due to the load exerted by the rocker arm 6 so that the exhaust valves 3 and 4 are opened.

During the return lift of the rocker arm 6, the counter-holder piston 48 is pushed in by the closing spring 30 against the spring force of the reset spring 51 until zero valve lash. Air located in the counter-holder space 50 can escape through the venting channel 59. Since the control piston 27 is at top dead center and closes the control channel 26, the valve bridge 5 is in its defined position so that the valve lash compensation mechanism 11 can compensate for valve lash. The reset spring 16 positions the compensation piston 12 in such a way that the valve lash is adjusted to zero. Owing to the vacuum pressure in the compensation space 15, oil flows out of the oil supply channel 17 through the check valve 18.

There is no adjustment of valve lash in the internal combustion engine 1 during engine assembly or subsequent operation. Valve lash is compensated automatically by the valve lash compensation mechanism 11. Owing to the fact that the control channel 26 can be closed by the control piston 27, the valve control unit 25 can be decoupled from the valve lash compensation mechanism 11 so that the exhaust valve 3 and the valve bridge 5 have a defined position for the compensation of valve lash. In particular, an automatic compensation of the thermal expansion of the exhaust valves 3 and 4 is also carried out. Since there is no clearance to be bridged, theoretical control times can be adhered to. This is also beneficial for the exhaust gas values. Further, the compensation of valve lash reduces noise in the internal combustion engine 1.

Further, the striking of the exhaust valves 3 and 4 in the associated seat rings is also automatically compensated over the life of the internal combustion engine 1. To this end, the counter-holder 45 and the valve lash compensation mechanism 11 are dimensioned so as to adjust to a determined maximum seat wear V.

The valve lash compensation mechanism 11 can be retrofitted in a simple manner. To this end, the valve bridge 5 must be exchanged and provided with the valve lash compensation mechanism 11. In order to mount the valve bridge 5, the compensation piston 12 and control piston 27 are moved out to the associated limiting pins 23 and 38. The valve bridge 5 is placed on the shaft ends, the control piston 27 is pushed into top dead center manually, and the adjusting screw of the rocker arm 6 is turned by hand until it contacts the compensation piston 12. This adjusts the valve lash to zero. The counter-holder 45 is then screwed on, and the counter-holder piston 48 is pressed on the valve bridge due to the reset spring 51.

Figure 2:
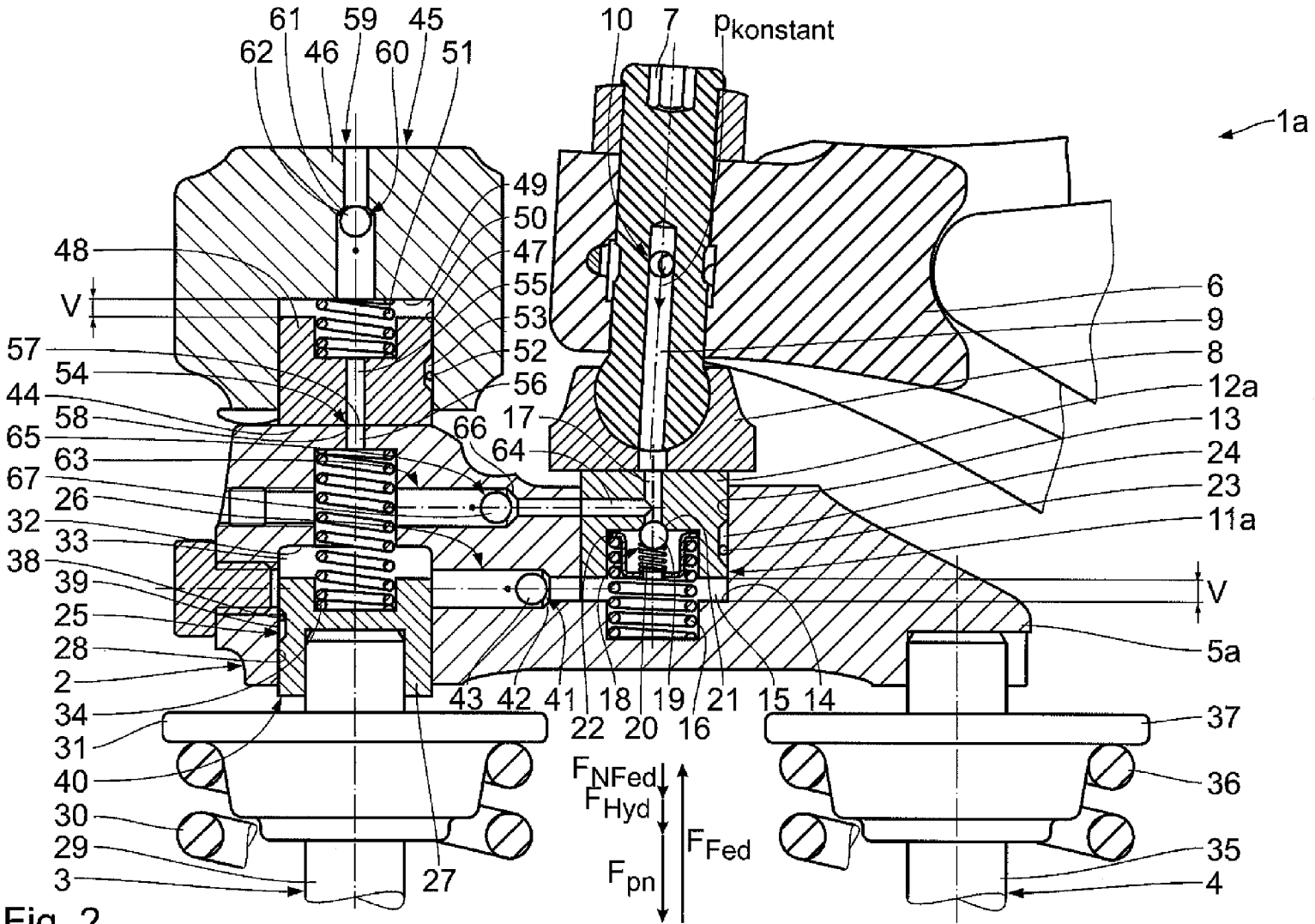
FIG. 2 is a cross-sectional view through a valve control unit and valve lash compensation mechanism according to a second embodiment example.

A second embodiment of the invention will be described in the following with reference to FIG. 2. Parts constructed identically to those in the first embodiment example have the same reference numbers, and reference is had to the description of the first embodiment example in this respect. Parts having a different construction have the same reference numbers with an 'a' appended to them.

In contrast the second embodiment, a bridging channel 63 is additionally formed in the valve bridge 5*a* and directly connects the oil supply channel 17 to the supply channel 54. For this purpose, the compensation piston 12*a* has a radial bore hole 64 which opens into the oil supply channel 17 and is part of the bridging channel 63. A fourth check valve 65 with a ball 67 which can be received in a ball seat 66 is arranged in the bridging channel 63. The check valve 65 is oriented such that the bridging channel 63 can be closed in direction of the oil supply channel 17.

In engine braking operation, the control space 33 and counter-holder space 50 are additionally filled with oil via the bridging channel 63 during the intermediate opening of the exhaust valve 3. The control space 33 and particularly the counter-holder space 50 can be filled faster due to the bridging of the compensation space 15 by the bridging channel 63. The check valve 65 prevents oil from flowing back in direction of the oil supply channel 17. The exhaust valve 3 is accordingly blocked in the intermediate open position. In contrast to the first embodiment example, the counter-holder space 50 is also filled with oil in normally fueled engine operation. As regards further operation, reference is had to the first embodiment example.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An internal combustion engine comprising:

an exhaust valve configured to remove exhaust gas from a combustion chamber of the internal combustion engine;

a valve bridge configured to support the exhaust valve;

a rocker arm configured to displace the valve bridge;

an engine braking device comprising:

a hydraulic valve control unit arranged between the exhaust valve and the valve bridge connected to an oil feed channel for supplying oil configured to hold the exhaust valve in an intermediate open position when the engine braking device is actuated;

a counter-holder configured to furnishing a stop for the valve bridge;

a hydraulic valve lash compensation mechanism constructed as a hydraulic piston-cylinder unit for the exhaust valve arranged between the rocker arm and the valve bridge and connected to the oil feed channel for supplying oil; and a control channel connected to the oil feed channel for feeding oil to the hydraulic valve control unit that can be closed by a closure element to compensate for the valve lash of the exhaust valve and the counter-holder configured to adapt the stop to a position of the valve lash compensation mechanism.

2. The internal combustion engine according to claim 1, wherein the valve control unit and the valve lash compensation mechanism are integrated in the valve bridge and the control channel is formed in the valve bridge.

3. The internal combustion engine according to claim 1, wherein the valve lash compensation mechanism comprises:

a compensation piston guided in a first cylinder bore;

a compensation space defined by the compensation piston;

a first reset spring arranged in the compensation space;

an oil supply channel that runs through the compensation piston and opens into the compensation space; and a first check valve configured to closing the oil supply channel.

4. The internal combustion engine according to claim 3, wherein the valve control unit comprises:

a control piston that is guided in a second cylinder bore;

a control space defined by the control piston; and a second reset spring arranged in the control space.

5. The internal combustion engine according to claim 4, wherein the control channel extends from the compensation space to the control space and opens into the control space such that the control piston forms the closure element.

6. The internal combustion engine according to claim 1, wherein a second check valve is arranged in the control channel.

7. The internal combustion engine according to claim 1, wherein the counter-holder comprises:

a counter-holder base body with a third cylinder bore;

a counter-holder piston that is guided in the third cylinder bore;

a counter-holder space defined by the counter-holder piston; and a third reset spring arranged in the counter-holder space.

8. The internal combustion engine according to claim 7, wherein the counter-holder piston has an axial through-bore that is part of a supply channel connecting the control space to the counter-holder space.

9. The internal combustion engine according to claim 1, wherein a venting channel with a third check valve is formed in the counter-holder base body.

10. The internal combustion engine according to claim 9, wherein a bridging channel connects the oil supply channel to the supply channel.

11. The internal combustion engine according to claim 10, wherein the compensation piston has a radial bore that opens into the oil supply channel and is part of the bridging channel integrated in the valve bridge.

12. The internal combustion engine according to claim 11, wherein a fourth check valve is arranged in the bridging channel.

* * * * *